US006106902A

United States Patent [19]

Koskinen et al.

[11] Patent Number: 6,106,902

[45] Date of Patent: Aug. 22, 2000

[54] METHOD AND APPARATUS FOR COATING A MOVING PAPER OR CARDBOARD WEB

[75] Inventors: Jukka Koskinen, Järvenpää ; Erkki Kirveskari, Halkia; Vilho Nissinen, Numminen; Jorma Kinnunen, Helsinki; Seppo Luomi, Järvenpää, all of Finland

[73] Assignee: Valmet Corporation, Helsinki, Finland

[21] Appl. No.: 09/051,247

[22] PCT Filed: Oct. 7, 1996

[86] PCT No.: PCT/FI96/00525

§ 371 Date: May 14, 1998

§ 102(e) Date: May 14, 1998

[87] PCT Pub. No.: WO97/13035

PCT Pub. Date: Apr. 10, 1997

[30] Foreign Application Priority Data

Oct. 5, 1995 [FI] Finland ..... 954745

[51] Int. Cl.[7] ..... B05D 1/02; B05D 3/12; B05B 13/02

[52] U.S. Cl. ..... 427/424; 427/326; 427/361; 427/382; 118/314; 118/315; 118/324; 118/304; 118/67

[58] Field of Search ..... 427/326, 424, 427/361, 382; 118/314, 315, 324, 304, 126, 67, 72, 117

[56] References Cited

U.S. PATENT DOCUMENTS

| | | | |
|---|---|---|---|
| 3,089,460 | 5/1963 | Mahoney et al. | 118/60 |
| 3,196,038 | 7/1965 | Schoch et al. | 117/68 |
| 3,413,139 | 11/1968 | Rasmussen et al. | 117/64 |
| 3,911,191 | 10/1975 | Guastella et al. | 428/342 |
| 4,944,960 | 7/1990 | Sundholm et al. | 427/27 |
| 5,112,653 | 5/1992 | Damrau et al. | 427/356 |
| 5,316,800 | 5/1994 | Noakes et al. | 427/466 |
| 5,622,599 | 4/1997 | Sproule et al. | 162/186 |
| 5,641,387 | 6/1997 | Baldini | 162/265 |
| 5,685,909 | 11/1997 | Reich et al. | 118/67 |
| 5,792,260 | 8/1998 | Rantanen et al. | 118/217 |

FOREIGN PATENT DOCUMENTS

WO 94/11116 5/1994 WIPO .

*Primary Examiner*—Shrive Beck
*Assistant Examiner*—Jennifer Calcagni
*Attorney, Agent, or Firm*—Cohen, Pontani, Lieberman & Pavane

[57] ABSTRACT

A method and apparatus for coating a moving web of paper of paper-board. In the method, the web to be coated is passed to a coater station, wherein a coat layer is applied to at least one surface of the web, and the web is dried at least to some degree and passed to the next treatment step. The coat is applied by spraying the coating mix on the web surface by a high-pressure spraying nozzles, the pattern width covered by a single nozzle is essentially narrower than the cross-machine width of the web being coated.

54 Claims, 7 Drawing Sheets

METHOD AND APPARATUS FOR COATING A MOVING PAPER OR CARDBOARD WEB

FIELD OF THE INVENTION

The present invention is directed to a method and apparatus for coating a moving web of paper or paperboard in which an applicator or levelling apparatus applies a coat layer to the web without contacting the web.

BACKGROUND OF THE INVENTION

To improve the printability of paper, the paper may be coated with a coating formulation containing mineral pigment and binder components. Over the years, application and levelling of the coat have been carried out using a variety of apparatuses. Higher web speeds and increased demands on process efficiency and paper quality in combination constitute the stimulus driving the development of applicator equipment.

Initially, paper coating with a pigment-containing formulation was performed using coaters of the gate roll type, in which the coating mix was first metered with the help of furnish rolls to a set of transfer rolls, and there-from further to the moving web of paper. However, the function of such a coater is impaired at web speeds exceeding 400 m/min. The nips of the rolls start to throw out splashes of the coating mix, and the coating process lacks the stability required to achieve an acceptable coat quality. Furthermore, well-behaved control of coat weight is difficult to achieve when using the above-described technique.

Particularly for surface sizing, sizing presses have been used in which the downward running web is passed through a coat mix pond sealed by the rolls. Herein, a problem arises from the strong increase of moisture content in the web and difficult controllability of the correct amount of applied size.

In the kiss-coating technique, the coating mix is metered directly in a nip from the casting roll to the surface of the paper web. In the early days, and in paperboard coating even today, excess coat is doctored away with the help of an air knife. At web speeds above 500 m/min, however, the impact force of the air flow from the slot orifice of the air knife is insufficient for effective doctoring of the coat layer applied to the web surface.

An essential increase in coating speed was facilitated by the adoption of the doctor blade levelling technique for controlling the final coat weight. In the first generation of blade coaters, the web was arranged to run from above downward, and the coating mix was pumped into a pond formed in the recess between the backing roll and the blade. In fact, the same technique is still being used in two-sided coating.

The actual break-through of the blade coating technique occurred along with the adoption of the transfer coating method. Herein, the coat is applied directly to the web surface in the nip between a transfer roll and a backing roll. Excess coat is removed by means of a doctor blade extending over the entire web width. This kind of coating technique makes it possible to increase the web speed to about 1300 m/min. At web speeds above this, splashing of the coat at the nip and the air film which is entrained in the nip along with the moving web, thereby causing skip marks on the coated web, make the use of this method extremely complex if not impossible. The higher the web speed, the fewer degrees of freedom will be available in the selection of coat mix components. Herein, the coating mix formulations must be selected under the constraints of web runnability, sometimes even compromising the quality of the end product.

Due to the poor runnability of transfer coaters, a short-dwell doctor blade coater was developed to provide an alternative technique for applying light coats to thin-caliper paper grades. In this type of coater, the web is guided past a slot orifice box which is formed by a short-dwell application chamber and the doctor blade and is adapted to operate against a backing roll. This method has been extremely popular in the art and facilitated effective on-machine coating. Also in this method, the maximum practicable web speed has turned out to be the limiting factor for further development. At web speeds above 1300 m/min, striping will appear at coat weights higher than 9 g/m$^2$ due to turbulence in the applicator flow chamber. In addition, an essential impairment of the cross-machine coat profile occurs with higher coat weights.

Improvements in the design of film transfer-type coaters typically used in surface sizing of paper have extended the use of these coaters to the application of pigment coats, too. Herein, the coating mix is first metered by means of an apparatus similar to a short-dwell coater onto a transfer roll, wherefrom the coat film is further transferred in a nip of two rolls to the surface of the paper web. This novel technique was initially introduced to surface sizing and later also to the application of a pigment coat at unconventionally high web speeds. However, problems are encountered in the form of coat mist and splashing occurring at the splitting point of the coat film when the web exits the film transfer nip. When applied at high web speeds, coats heavier than 10 g/m$^2$ suffer from an orange-peel texture and other low-quality surface properties incapable of fulfilling all the specifications that are set on a finished end product.

The coat splashing and web skipping problems occurring on the application roll have generally been overcome by means of the nozzle application technique, which gives a wider latitude in the direction of higher web speeds. Additionally, better capabilities of applying heavy coat weights have been attained through more effective water drainage offered by the longer dwell time. Moreover, the coat forms a layer of higher solids content close to the base sheet surface that provides support to the doctor blade, whereby blade stability is improved and cross-machine profiles of improved evenness are attained.

When the nozzle-application step based on a doctor blade and a subsequent levelling step based on a scraper element are performed against the same backing element, a runnability complication in the form of creases and/or bags in the web generally occurs. This problem can be eliminated by implementing the application and levelling steps against separate backing elements. Due to the resultant increase of dwell time and paper moisture content, some difficulties will be encountered in the runnability of lightweight and high-moisture-absorbance paper grades.

The striping problem of short-dwell coaters has been alleviated with the dam blade construction known from the film transfer method of coating. However, all the above-described application methods are hampered by the mechanical contact and load imposed on the web by the coater. Particularly in blade coaters, paper production will easily be disrupted by defects in the base sheet. Paper mills have a strong drive to improve the efficiency of coater lines. Obviously, valuable production time will be lost due to web breaks. In conventional application techniques, the time to regain an acceptable quality after a web break takes an unduly long time.

For wet-on-wet coating, a blade coater is not necessarily the best possible alternative. In this coating method, to the same side of the web are applied at least two coat layers so that onto the first coat, while still moist, is directly applied the next coat layer without intermediate drying. Particularly in the application of a precoat, web defects like striping and unevenness are extremely detrimental. Therefore, a blade coater requires continuous control to keep the coat weight at its set value. Hence, a facility for measuring the precoat weight is mandatory in order to maintain controlled coat application. Such a coat weight measurement system operating between the successive application steps of coat layers is expensive and sometimes even impossible to arrange. Therefore, stable operation is required from wet-on-wet coaters so that the application and levelling of subsequent coat layers can be carried out without spoiling the already applied, still moist coat layers.

Attempts have been made to improve runnability in paper machines and coating stations with the help of supported web threading. Herein, an extremely smooth surface is required from the support wires or belts used in coaters. Furthermore, even the smallest irregularities of backing surfaces will cause coat marking not only particularly in blade coaters, but also in transfer coaters.

At higher web speeds, the rate of successfully performed flying splicing on the unwinder of off-machine coaters falls significantly. Splicing apparatuses required herein become expensive, and nevertheless problems will occur in exact timing of splicing. Therefore, future development of coaters must aim to provide an on-machine coater embodiment in which such problems associated with splicing and roll change cannot disturb the finishing treatment.

A blade performing the doctoring of the coat applied to the web tends to accumulate aggregations of dirt under the blade edge that cause striping of the coat. Due to such coating defects, large amounts of finished paper turn into scrap.

The rheological properties of the coating mix may cause web runnability problems due to the extremely strong fields of high shear rate acting on the coat mix in the blade tip region. Accordingly, the selection of possible coating mix formulations is often curtailed by the rheological constraints associated with the blade geometry.

In order to overcome the above-described drawbacks, paper coating should preferably be carried out using a noncontacting method. Through the use of a noncontacting method for coating the web, defects of the base sheet are prevented from disturbing the finishing treatment. Complemented with a web threading system which is fully supported by wires and belts, it is possible to achieve a break-free, even a fully automated coating process. Herein, paper web defects can be identified by means of defect detectors and removed during intermediate winding in order to prevent them from interfering with further processing. Development of equipment for higher web speeds is no more hampered by load imposed on the web. The opacifying power of the applied coat becomes so good that the air knives, which today are the major factor limiting the maximum speed of paperboard coaters, can be replaced by the novel technique. Thus, the efficiency of coating lines and production throughput of coaters can be elevated to a remarkably high level.

In other prior art non-contacting coating methods such as that disclosed in PCT/US91/03830, the coating mix is fed into the nozzle via a separate duct, and atomization of coating mix is performed with the help of compressed air passed to the nozzle. However, tests to be described in greater detail later in the text have shown that insufficient atomization results from the use of a nozzle based on blast-diffusion by compressed air. Moreover, such a strong airflow causes excessive evaporative drying of the coating mix droplets before they can impinge on the sheet surface. Droplets of excessive size in the coat mist make the finished surface pitted and unsmoothly coated, which is manifested in the coat profile as craters and mounds.

U.S Pat. No. 4,944,960, discusses applicator apparatuses in which the coating mix aerosol is formed in a separate chamber or apparatus using a gas-liquid nozzle or ultrasonic diffusor nozzle. The coat aerosol is passed into an applicator nozzle, wherein the aerosol is directed by means of separate gas injection to impinge on the sheet surface. The portion of the coating mix aerosol not adhering to the web is returned by suction back into the coating mix circulation. In such an apparatus, the coating mix droplets undergo evaporation before reaching the sheet surface, whereby their adherence to the sheet is impaired. Subsequently, when the paper is used in a printing shop, a large amount of dirt will build on the printing machine rolls and the coat will release dust in the trimming and folding equipment.

In the apparatus described in WO 94/116, the coat is applied using the above-described methods and then levelled using a doctor unit. This method represents a kind of direct application with the exception of its conventional doctor blade technique, the shortcomings of which were described above.

Noncontacting coater equipment are well-known and frequently used apparatuses in the art of painting and coating systems technology. High-pressure spraying equipment with suitable nozzles are commercially available for painting. However, the use of high-pressure spraying for applying coating mix to a moving web of paper or paperboard in the fashion described in detail later is a novel application of the noncontacting application technique.

In order to make it possible to spray a coating mix or material onto a surface to be coated, the fluid material must be dispersed into small droplets. This step is called atomization. The basic idea of atomization covers a variety of different uses ranging from painting to varied combustion installations, engines and apparatuses for mass and heat transfer such as gas scrubbers and evaporation towers. As a general term, atomization refers to conversion of fluid material into droplet form (that is, particles of round or similar form). The type of the spray is categorized according to the cross-sectional shape of the spray jet. Normally, a hollow or solid conical or fanned spray is used. Spray coverage is defined as the width of the spray pattern at a certain distance from the nozzle tip. The spray angle is the opening angle of the spray cone emitted by the nozzle.

Atomization nozzles fall into four different classes:

1) High-pressure airless nozzles (pressure atomizers)
2) Atomizers based on rotary centrifugal atomization (rotary atomizers)
3) Air-assist and air-blast nozzles (twin-fluid atomizers)
4) Other methods.

High-pressure atomizers are characterized in that therein atomization occurs driven alone by the internal pressure of the fluid being atomized. No atomizing air is used. In practical tests, airless atomizing nozzles have been found superior to air-blast nozzles.

In pilot-scale tests of the present invention, the spraying technique was first adapted to the application step of the coating mix. Levelling of the applied coat was performed using conventional doctor blade techniques. However, this combination did not offer any benefit over prior-art nozzle application methods.

The following shortcomings were found in this method:

for the nozzle types used in the test, the viscosity of the coating mix was too high to permit sufficient atomization of the coating mix to apply a smooth coat;

coating mix droplets did not gain sufficient kinetic energy to adhere and spread sufficiently on the sheet surface; and pressure levels used in the fluid atomizing nozzles were insufficient for the atomization of the coating mix.

Coating mix used in the atomization application method must have a sufficiently high kinetic energy to drive the coat droplets formed at the nozzle web against the sheet surface to flatten and adhere to the web surface. At higher web speeds, the droplets must also be capable of penetrating the barrier formed by the air film travelling along with the moving sheet surface. These requirements cannot be fulfilled by means of an air-blast atomizing nozzle. This is because the blasting air flow causes strong evaporation of the coat droplets, whereby the deposition and spreading of the coating mix droplets on the sheet surface is worsened. Hence, the achievable coat quality remains unsatisfactory.

SUMMARY OF THE INVENTION

It is an object of the present invention to provide a noncontacting method of coat application free from the shortcomings of the above-described techniques.

The goal of the present invention is achieved by means of performing the coat spraying step onto the sheet surface with the help of high-pressure nozzles.

In accordance with the present invention, coating is applied to a surface of the web by spraying the coating mix onto the web surface using high pressure spraying nozzles so that the spray pattern width covered by a single nozzle is essentially narrower than the cross-machine width of the web being coated. The applied coating is then at least partially dried.

The present invention offers significant benefits.

The present method of entirely noncontacting coat application, which is free from any need for coat doctoring, is capable of significantly improving the runnability of coating equipment. The method applies no strong forces loading the web, whereby coating may be carried out against a web running over a backing roll, belt or even unsupported. High-pressure airless spraying nozzles give an extremely smooth surface, which has a coat profile similar to that obtained by means of an air knife, however, with a smoother profile, in some cases even smoother than that of a doctored coat. Obviously, the smoothness of the coated web is affected by the base sheet profile, and therefore, the base sheet to be coated is advantageously run through a precalendering step prior to the application of the sprayed coat. In the method, the coat settles as a uniform layer of constant thickness on the base sheet surface, whereby a high opacifying power of the coat layer is attained. Hence, the method is particularly suited for coating only semibleached paperboard grades. The control of coat weight and profile is easy by way of altering the number of nozzles and the coat pumping rate to each individual nozzle. On the basis of tests performed, it appears that the impact of the coat spray on the sheet does not cause strong migration of water from the coating mix into the base sheet. The method is extremely well suited for wet-on-wet coating, because the coat sprays emitted by the nozzles do not agitate the previously applied layer and the load imposed on the moist web remains low.

Other objects and features of the present invention will become apparent from the following detailed description considered in conjunction with the accompanying drawings. It is to be understood, however, that the drawings are intended solely for purposes of illustration and not as a definition of the limits of the invention, for which references should be made to the appended claims.

DETAILED DESCRIPTION OF THE PRESENTLY PREFERRED EMBODIMENTS

Figure 1:
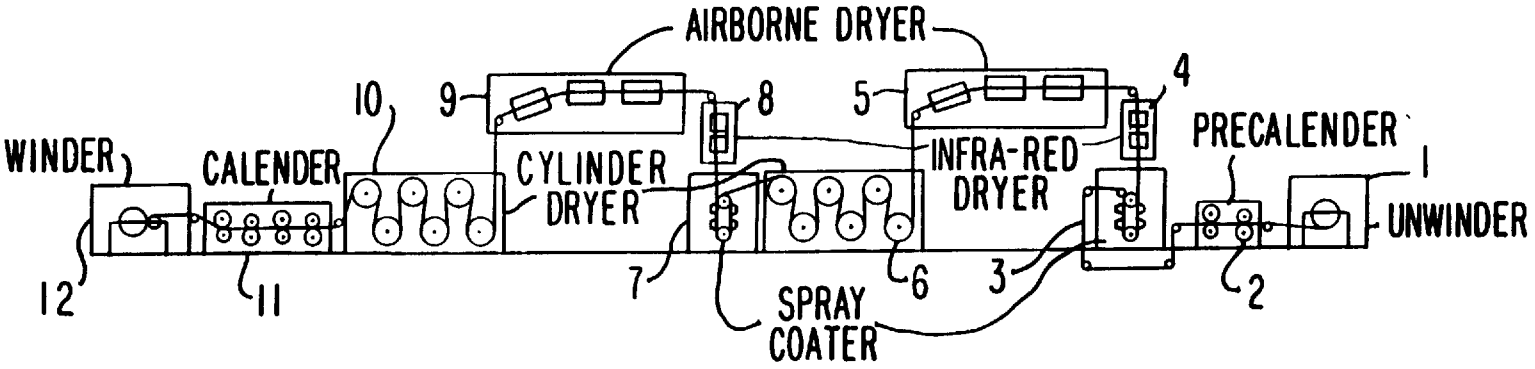
FIG. 1 shows a first coating line configuration implemented according to the present invention.

According to the present invention, the coat is applied to a web 1 by means of high-pressure airless spraying nozzles. The fluid coating mix is atomized in the nozzle heads by passing the pressurized liquid through a small-orifice nozzle. Thence, the core component of the spray-coater apparatus is the coat-atomizing nozzle. Test results indicate that high-pressure spraying nozzles of the airless type are generally to be preferred. The fluid may be pressurized in the range of 1–1000 bar. However, pressures typical in the art vary in the range 100–300 bar. It has been found that pressures under 100 bar can, under no conditions, atomize the coating mix into droplets of sufficiently small size.

Typically, the spray-coater apparatus includes a nozzle assembly incorporating nozzles designed to emit fan-shaped sprays. The main axes of the fanned spray patterns of the nozzles are rotated by approx. 7–15° with respect to the cross-machine main axis of the nozzle set, whereby a relatively smooth coat profile results. The nozzle assembly is also characterized by an adjustment facility of the inter-nozzle distance and the distance of the entire nozzle assembly from the base sheet. The simplest design of the nozzle adjustment is such that it offers a simultaneous adjustment for all the nozzles of the system and provides as identical conditions as possible for all the nozzles. Obviously, a separate adjustment for each nozzle would give certain latitude for the coat profile control over the cross-machine width of the nozzle spray pattern. Additionally, individual control of the nozzles could be used to some extent for compensation of orifice wear in the nozzles.

On the basis of tests performed, it has been found that the effective practicable spray pattern width achievable by means of a single nozzle is about 10 to 30 cm. This means that from 10 to 3 nozzles, respectively, are required per linear meter of web width. As it is plausible that a uniform coat quality cannot be attained by means of a single linear array extending over the entire web width, the spray-coater apparatus advantageously comprises a plurality of linear nozzle arrays.

Formation of coat mist is one of the problems of the spray-coating method needing an effective solution. Elimination of coat mist formation can be categorized into four tasks: 1) the conditions of coating mix spraying are made such that the deposition of sprayed particles on the web occurs as unobstructed as possible, which in practice means removal of the air film travelling along with the surface of the moving web; 2) such nozzle designs are selected that produce droplets of as uniform size as possible, whereby the number of droplets of small size and kinetic energy is minimized; 3) the adhesion of the coat droplets to the web is maximized by all means, whereby such operating parameters as the electrostatic charging of the droplets, coating mix formulations and appropriate impact force of the fluid droplets on the web must be evaluated; and 4) suitable mechanical mist collector systems are used.

The spraying-nozzle unit must be located so that it can be sealed sufficiently tightly against a suitable backing surface. Such surfaces are offered at least by a web-supporting roll, belt, felt or wire. In this context, the term sealing refers to the sealing of the peripheral areas of the applicator unit and of the edge areas of the web as well as controlled travel of the web at the ingoing and outgoing ports of the spray-coater. Such sealing is extremely crucial for proper collection of the stray coat mist.

Spray-coating requires efficient removal of the air film travelling along with the web. The air film forms a barrier to the deposition of the sprayed particles on the web. As the removal of the air film also helps to reduce the formation of coat mist, the air film should be removed as effectively as possible and as close as possible to the ingoing port of the spray-coater unit. The removal of the air film from the web surface can be accomplished. by means of an arrangement operated in a doctor blade fashion, or alternatively, by adapting an air knife to blow against the web travel direction. By contrast, removal of the air film from the web surface inside the spray-coater unit may become a complicated task, because the coat mist tends to deposit on any surface inside the spray-coater unit.

Doctoring-away of the air film is an important step to be carried out just before the ingoing side of the spray-coating assembly. Such a doctoring of the air film can be implemented by means of, e.g., counterblowing based on air injection from an air knife reverse to the web travel direction. Also various doctor blade arrangements are suitable for the removal of the air film. The optimum location for such an air-layer-doctoring accessory is in the immediate vicinity of the spray-coater ingoing side. While the accessory elements may also be located inside the housing of the spray-coater unit, such a placement necessitates additional clean-keeping arrangements.

The coating mix must be furnished into the coating mix machine tank of the coater separately for each coating run with a specific formulation suited for spray-coating. The replenishment of fresh coating mix into the machine tank can be arranged to occur continuously or batch-wise. An essential requirement herein is that the coating mix must have a homogeneous composition with suitable physical properties. The constituents of the desirable coating mix formulation are determined separately for each base sheet type and grade. The viscosity and solids content of the coating mix are adjusted to be compatible with the spray-coating method. Generally, coating mix formulations optimized for spray-coating have a low solids content and viscosity as compared to coating mixes used with a doctor blade coater.

In the following, examples are given of various coating line arrangements using spray-coater units for coat application.

Shown in FIG. 1 is a simple off-machine coating line adapted for single-layer, two-sided coating of paper web. The first unit of the line is an unwinder 1, after which the web is taken to a precalender 2 comprised of, e.g., a nip of two soft rolls and one hard roll. Next after the precalender 2 is a spray-coater unit 3 in which a desired coat layer is applied to the first side of the web. The actual coater unit comprises a belt-backed coater in which the coat is applied in two steps to the web supported by the belt. Such a coater unit is capable of applying a heavy coat in a single pass. Subsequent to coating, the web is threaded to an infra-red dryer 4, followed by drying on an airborne dryer 5 and finally on a cylinder dryer 6. Immediately after drying, the dried web is passed to a second spray-coater unit 7, followed by another sequence of the above-described equipment comprising drying on an infra-red dryer 8, airborne dryer 9 and cylinder dryer 10. Subsequent to drying, the paper web is recalendered on a machine calender 11 comprising four nips and rewound into rolls on a winder 12. The coating line of FIG. 2 differs from the above-described system in that the winder is immediately after the second coater and dryer section. The line is complemented with separate calenders, a soft-nip calender 13 and a supercalender 14.

Figure 2:
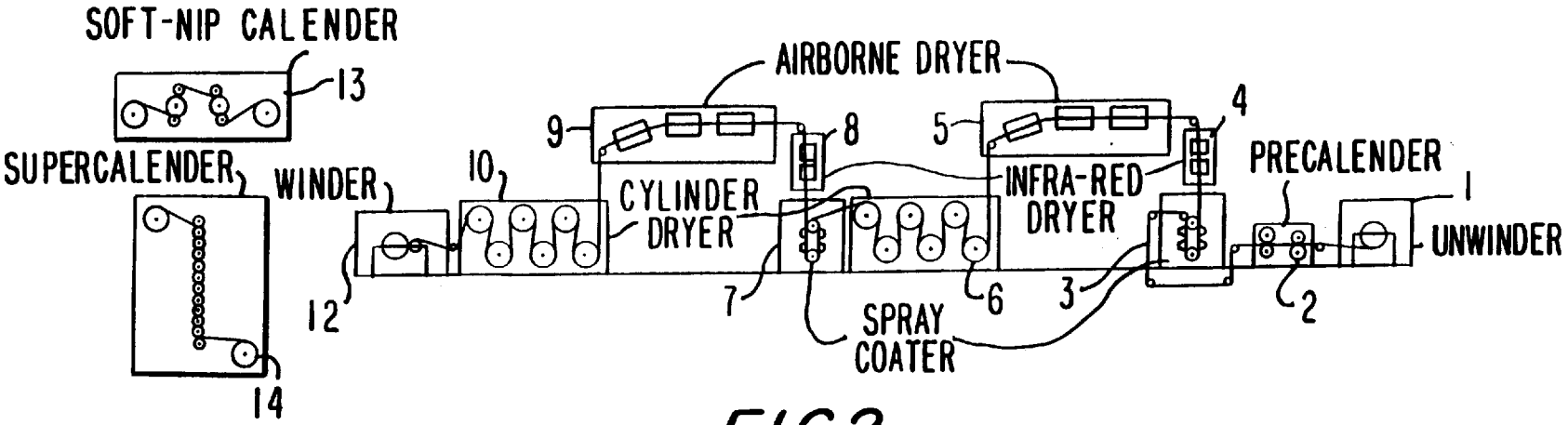
FIG. 2 shows a second coating line configuration implemented according to the present invention.
Figure 3:
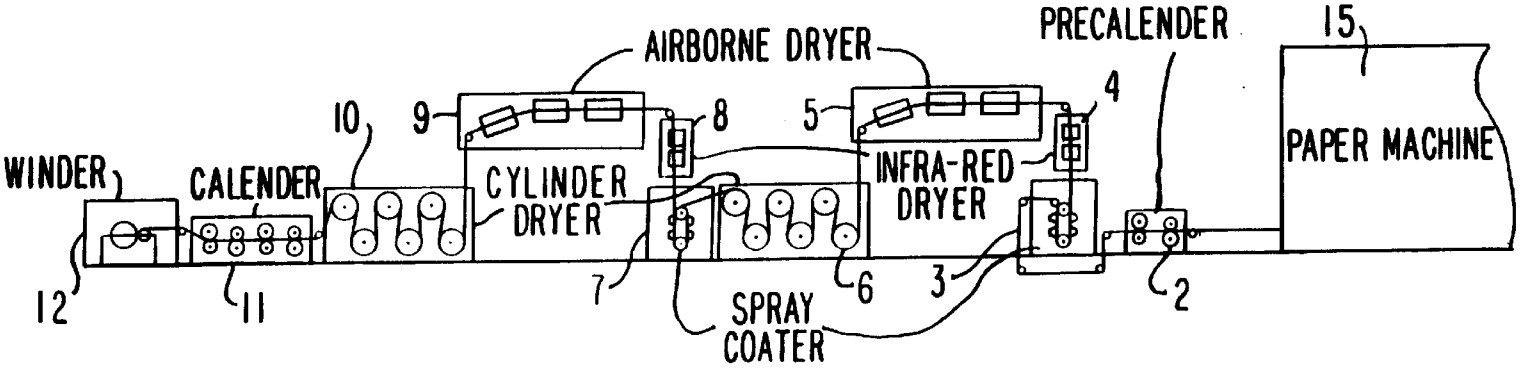
FIG. 3 shows a third coating line configuration implemented according to the present invention.
Figure 4:
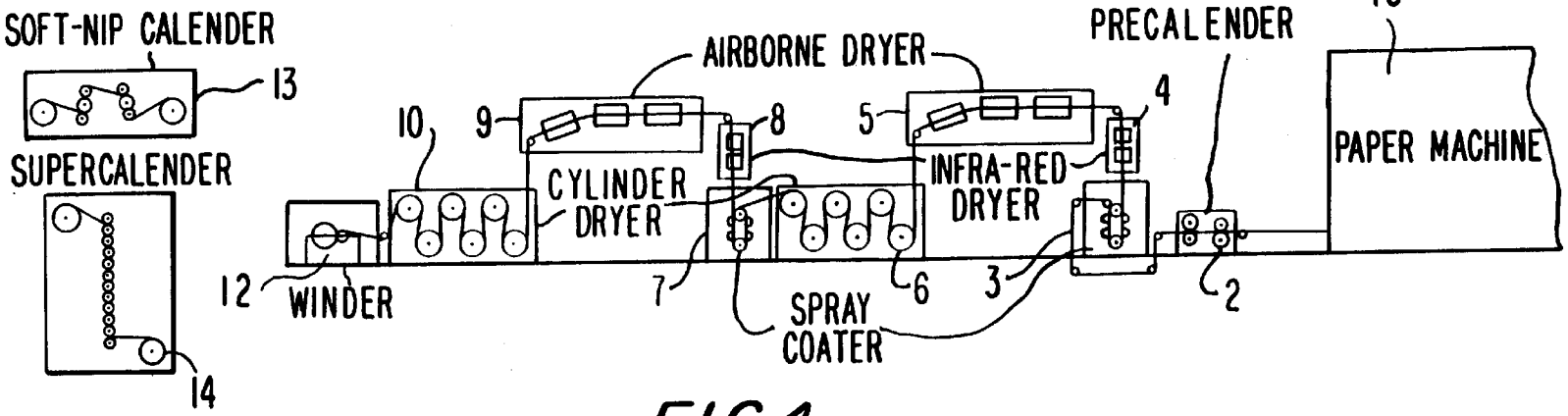
FIG. 4 shows a fourth coating line configuration implemented according to the present invention.

One of the benefits of the coating lines shown in FIGS. 1 and 2 is their simple structure which, however, with the help of pre- and postcalendering is capable of providing a very smooth coat combined with the extremely good opacifying power of spray-coating. Additionally, the equipment of FIG. 2 can be readily modified for making paper grades of different finishes by varying the coating mix formulation and the degree of calendering. The coating lines of FIGS. 3 and 4 are equivalent to those described above with the exception that they are directly connected to a paper machine 15.

Figure 5:
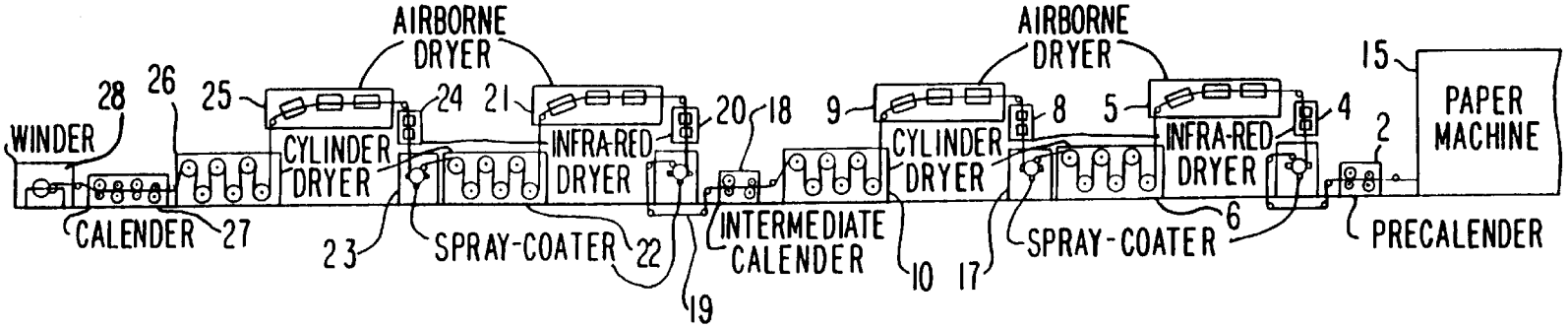
FIG. 5 shows a fifth coating line configuration implemented according to the present invention.

In FIG. 5 is shown a paper machine 15 directly followed by a coating line for two-sided coating of a paper web. The web exiting the paper machine 15 is first taken to a precalender 2, followed by a spray-coater station 16, which in the illustrated configuration comprises three spray-coater units, all of them being adapted to apply the coat to a web passed over a backing roll. After the application of the first coat layer, the web is dried in the above-described fashion, and subsequently the other side of the web is coated on a backing-roll-type coater station 17, then dried and finally passed to an intermediate calender 18. Intermediate calendering is followed by the application of a second coat layer first to the first side of the web on a coater station 19, followed by a drying sequence comprised of an infra-red dryer 20, an airborne dryer 21 and cylinder dryers. The other side of the web is coated on the coater station 23 and dried on dryers 24, 25, 26, followed by the calendering 27 and winding 28 steps. Because of the improved runnability of the spray-coater line over all conventional coating methods, the method is highly suited to on-machine coating. The configuration shown in FIG. 5 produces extremely smooth paper, since the precalendered and already spray-coated paper as such has a relatively smooth surface, which is further smoothed by intermediate calendering. Thence, the coat layer applied in the second stage is sprayed onto a smooth paper surface, thereby improving its smoothness prior to final calendering, which still more enhances the coat smoothness. Further, the double-layer coating can be made using different kinds of coats, whereby the whiteness and other properties of the finished sheet can be made extremely good.

Figure 6:
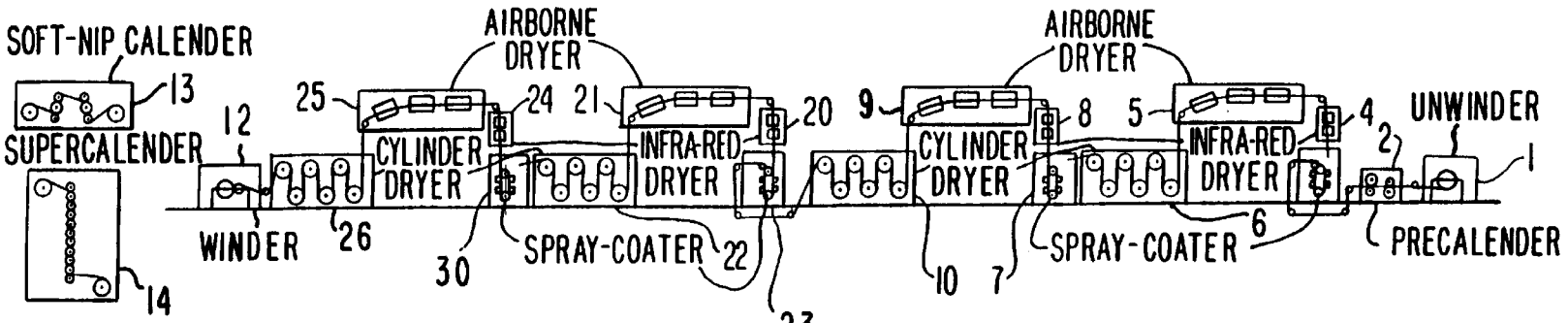
FIG. 6 shows a sixth coating line configuration implemented according to the present invention.

The configuration of FIG. 6 is an off-machine coating line for two-sided coating of paper web. Therein the coater stations are belt-backed spray-coater stations 3, 7, 29, 30, which can be used to apply a large amount of coat. Drying herein is performed analogously to the above-described examples with infra-red, airborne and cylinder dryers. While the intermediate calendering stage between the application of the first and second coat layers is omitted, the configuration is complemented with a separate soft-nip calender 13and a supercalender 14. Thence, the different calendering methods can be used so as to affect the surface gloss of the finished sheet making the configuration of FIG. 6 suitable for manufacturing paper grades optimized for different printing purposes through varying the formulation of coating mixes and the method of calendering.

Figure 7:
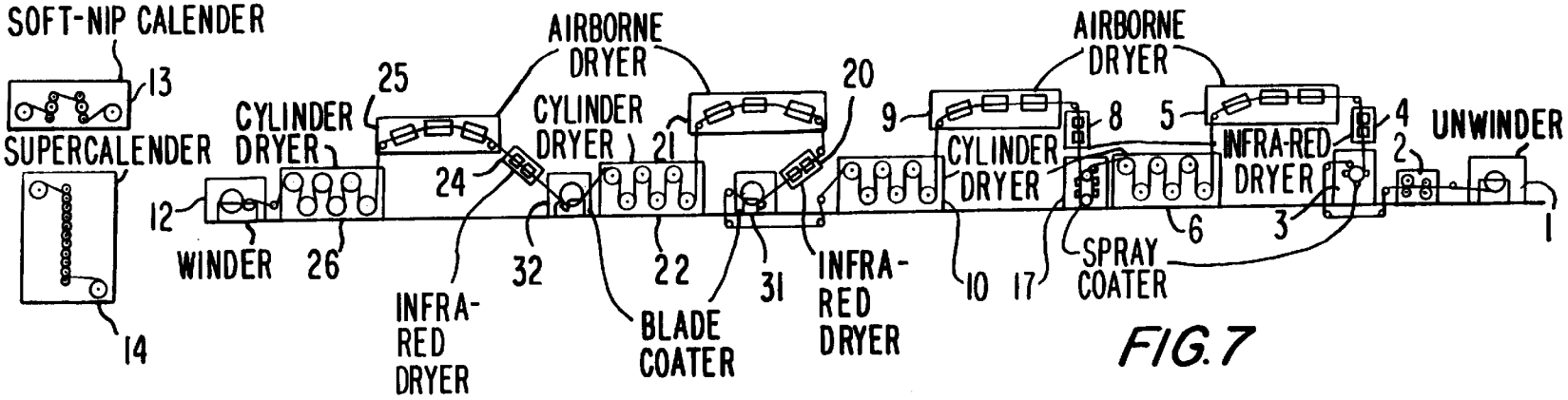
FIG. 7 shows a seventh coating line configuration implemented according to the present invention.

In FIG. 7 is shown a double-layer coating configuration in which the first coat layer is applied by the spray-coating method and the second layer by a blade coater. Paper finishing starts from an unwinder 1, followed by a precalendering stage 2 and application of the first coat layer on a belt-backed spray-coater station 3. Drying is carried out analogously to the preceding examples. The other side of the web is coated and dried in the above fashion, followed by blade coating on both sides of the web. In the illustrated example, the blade coating is carried out on kiss-coater stations 31 and 32. The coat applied by the casting rolls is dried in the same fashion as the sprayed coats, but the web is herein thread slightly differently due to the modified structure of the coater stations 31, 32. After two-sided coating and drying of the web, the web is taken to the winder and calendered if necessary on separate soft-nip and supercalenders 13, 14. In this coater configuration, the paper surface can be finished to the coat smoothness characteristic of blade coating, whereby the sheet surface quality becomes slightly different from that offered by spray-coating alone. Further, since blade coating can use coat formulations different from those of spray-coating, it is herein possible to use blade coating in the case that the coating mix desirably used in the top coat is not suitable for spray-coating due to, e.g., its high viscosity. Also this arrangement provides an extremely high surface quality, because it combines the good opacifying power of spray-coating with the smooth profile and high surface quality of blade-coated sheet.

Figure 8:
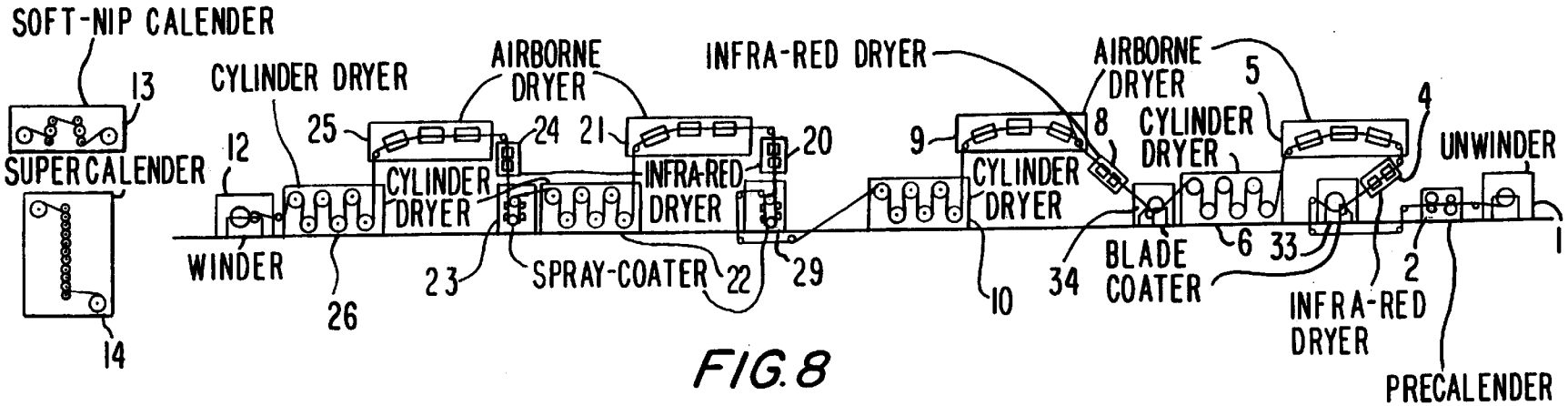
FIG. 8 shows an eighth coating line configuration implemented according to the present invention.

In FIG. 8 is described a coating line configuration in which the order of the spray-coater and blade coater sections are interposed. In this coating line, the first coater section using a doctor-blade apparatus 33, 34 applies to the sheet surface a coat layer capable of filling the pores of the web, whereby the web surface is smoothed so that also the sprayed coat applied 29, 30 next to this smooth surface also gives a smooth final coat profile. However, as the coat profile obtained by spray-coating is not as planar as a doctored surface, the final coat quality is slightly different from that obtained by the coating line configuration of FIG. 7. owing to spray-coating, extremely good opacifying power is obtained in both con figurations.

Figure 9:
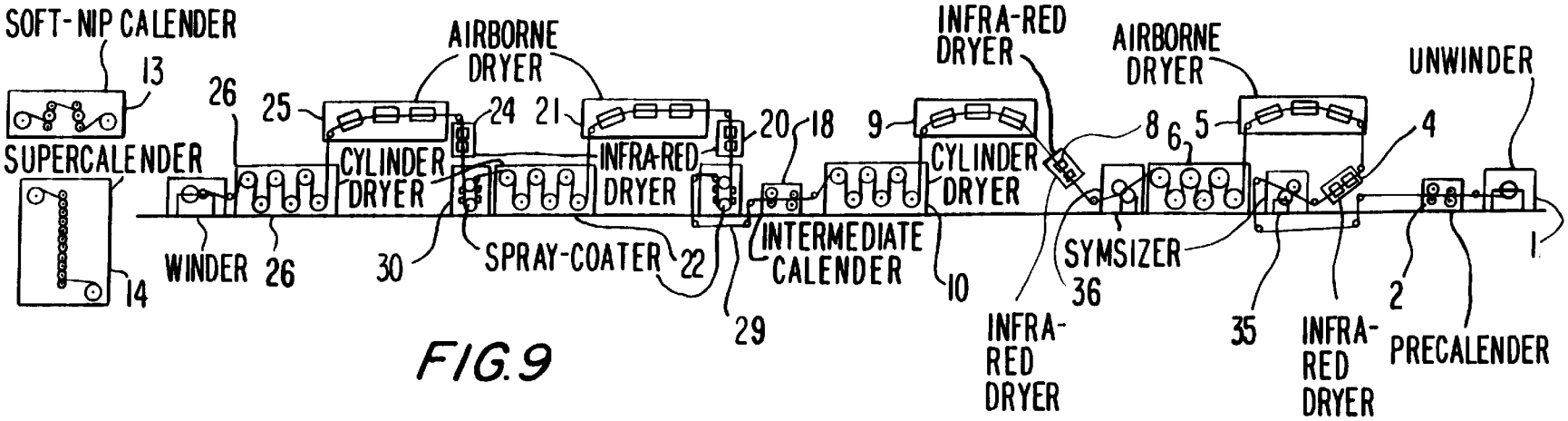
FIG. 9 shows a ninth coating line configuration implemented according to the present invention.

In the coating configuration of FIG. 9, the spray-coater section is combined with a film transfer coater section. Herein, film transfer coating is carried out as the first application stage in the same fashion as in most prior-art coater arrangements. Since the film transfer coating method imposes minimal stress on the web and is highly reliable, the coating line of FIG. 9 can provide extremely good runnability combined with low load on the web. Also in this configuration the web is passed immediately after the unwinder 1 to a precalender 2, followed by the application of the first coat layer on a film transfer coater 35. The other side of the web is treated similarly by the next film transfer coater 36, followed by drying in the same fashion as the preceding examples. After both sides of the web are treated, the web is passed to an intermediate calender 18, followed by coating on spray-coaters 29, 30 and winding up. When necessary, finishing calendering can be made on a separate soft-nip calender 13 or a supercalender 14. The principal benefit of this configuration is the good opacifying power of the applied coat combined with good runnability. Particularly by virtue of the excellent runnability, the illustrated configuration can be used for coating the most lightweight base sheets.

Figure 10:
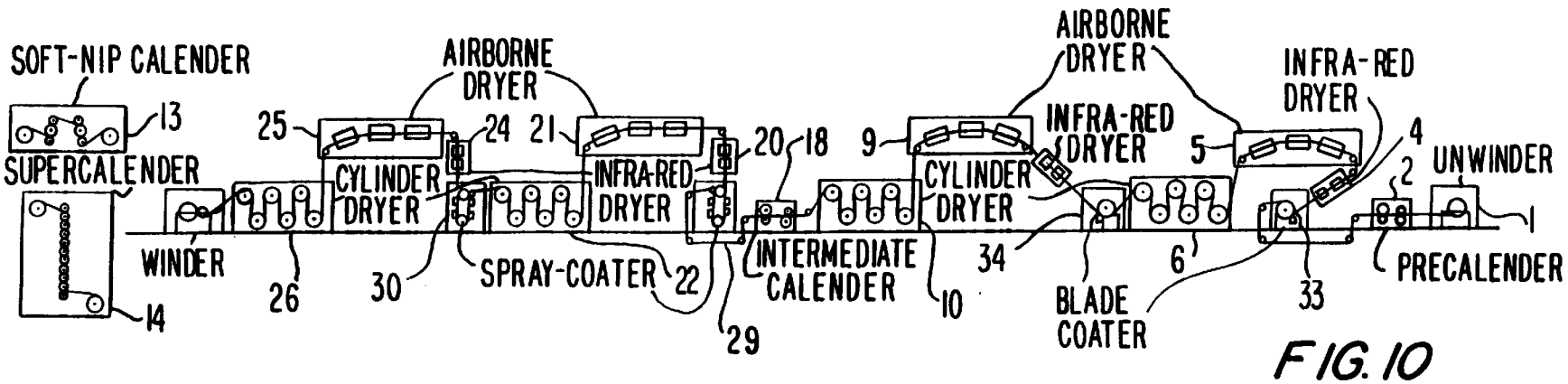
FIG. 10 shows a tenth coating line configuration implemented according to the present invention.

The configuration of FIG. 10 is otherwise equivalent to that described above with the exception that the film transfer coaters used for applying the first coat layer are replaced by blade coaters 33, 34. Hence, this configuration is similar to that of FIG. 8 with the exception of the intermediate calender 18. Owing to such intermediate calendering, this configuration makes it possible to manufacture even smoother paper than that provided by the configuration of FIG. 8.

Figure 11:
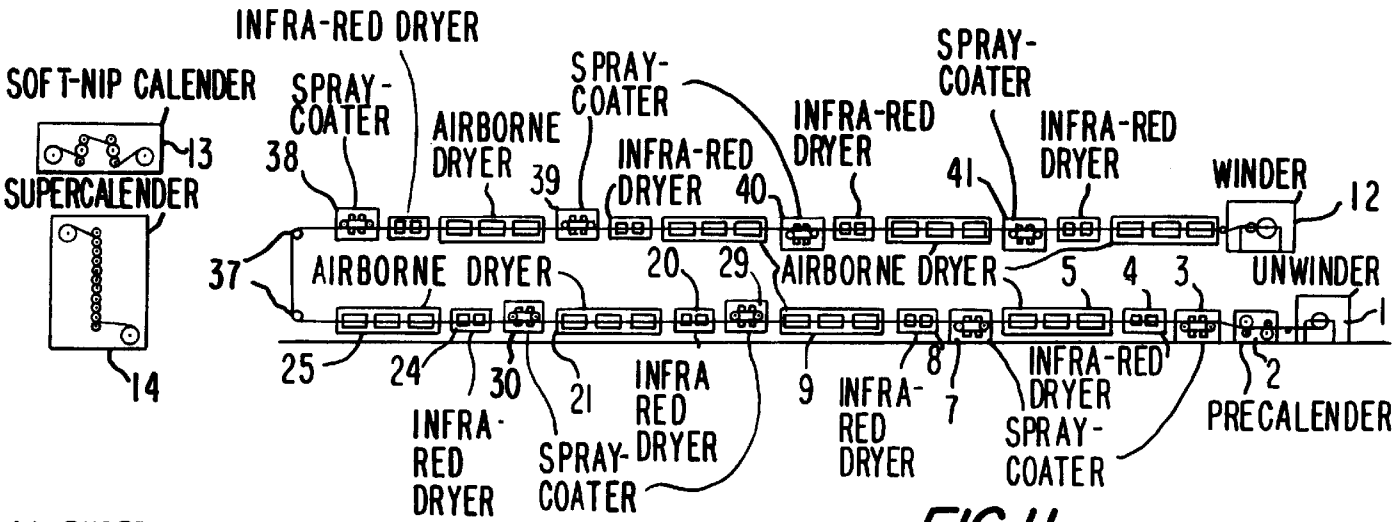
FIG. 11 shows an eleventh coating line configuration implemented according to the present invention.
Figure 12:
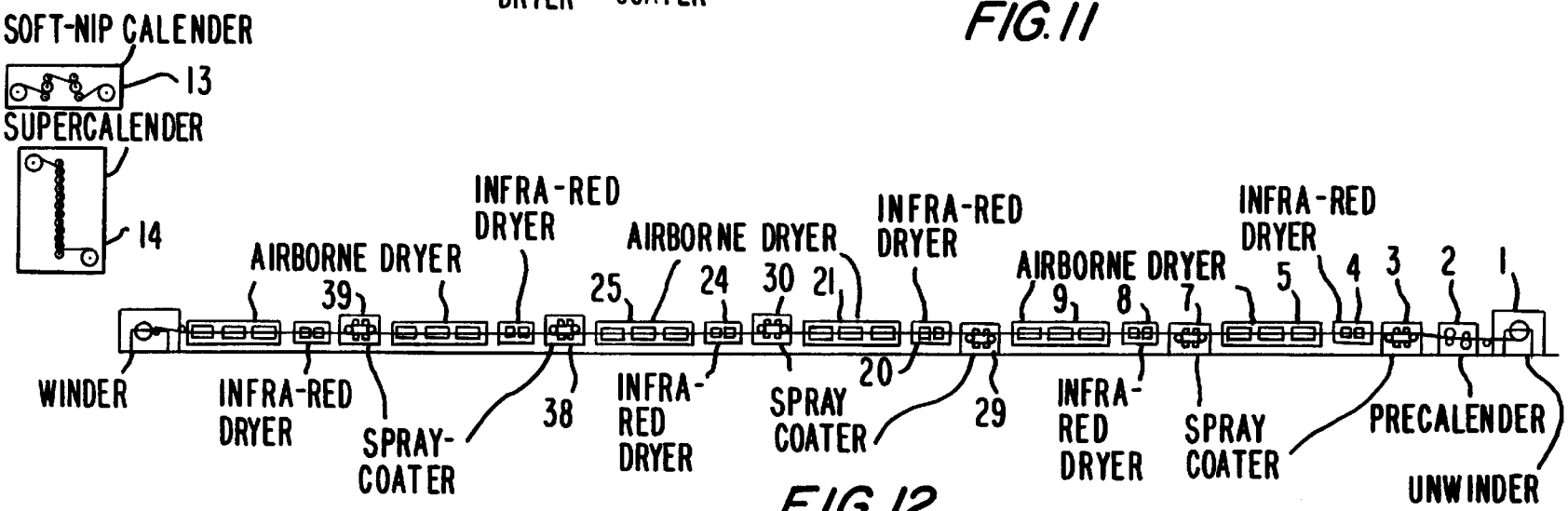
FIG. 12 shows a twelfth coating line configuration implemented according to the present invention.

FIGS. 11 and 12 illustrate configurations which feature superior runnability over conventional coating lines. In both examples, coating and drying takes place noncontactingly. In the configuration of FIG. 11, the unwinder 1 is immediately followed by a precalender 2, wherefrom the web is passed to a belt-backed spray-coater 3. From the coater 3 the web is passed straight without essentially deflecting its direction to an infra-red dryer 4 and therefrom to an airborne dryer 5. After drying, the other side of the web is coated and dried in a similar fashion, followed by the application and drying of the second coat layer. The web is threaded substantially straight over its path through the two application stages and is only contacted by the support belts of the spray-coater stations 3, 7, 29, 30.

After double-layer coating of the web, the web is deflected by guide rolls 37 to run upward and backward for a second double-layer coating sequence on belt-backed spray-coaters 38, 39, 40, 41. This sequence of the third and fourth coating steps with their drying steps is carried out in a similar fashion to those of the two preceding coating steps, and finally the web is passed to a winder 12. When necessary, finishing calendering can be made by a separate soft-nip calender 13 or a super-calender 14.

The configuration of FIG. 12 is otherwise similar to that of FIG. 11 with the exception that all coating steps are carried out on a single coating line. The benefit of this configuration is the entirely linear path of the web, however, involving the penalty of long footprint in the machine direction.

By virtue of the configurations of FIGS. 11 and 12, the advantages of noncontacting spray-coating can be maximally benefitted as the web is passed through the entire coating line almost without any mechanical support. Furthermore, no load is imposed on the web during coating or drying. Advantage is also taken from the cost-efficient structure and small dimensions of spray-coaters which can readily be adapted to a rather wide spectrum of paper treatment tasks. As the spray-coating method is capable of applying extremely thin coats, too, multilayer application up to four passes can be performed economically in order to achieve a certain type of coat, even when the overall coat thickness must be relatively small. Obviously, the same coating method is capable of applying thick coats, too. Hence, this type of multilayer coating opens new possibilities of manufacturing improved paper grades that can be better tailored for a specific use. The coating line is extremely adaptable, offering fast change of paper grade, whereby smaller lots can be flexibly manufactured according to customer needs and market demand.

Since the spray-coating method according to the present invention does not agitate the previously applied coat layers, the above-described exemplifying embodiments of coating lines can be configured into wet-on-wet coating lines if the number of dryers is desiredly reduced due to lack of installation space or need for reducing the equipment price. Herein, one of significant benefits of the present invention is utilized, namely, that the web need not necessarily be dried entirely after one application step before the next application step.

Figure 13:
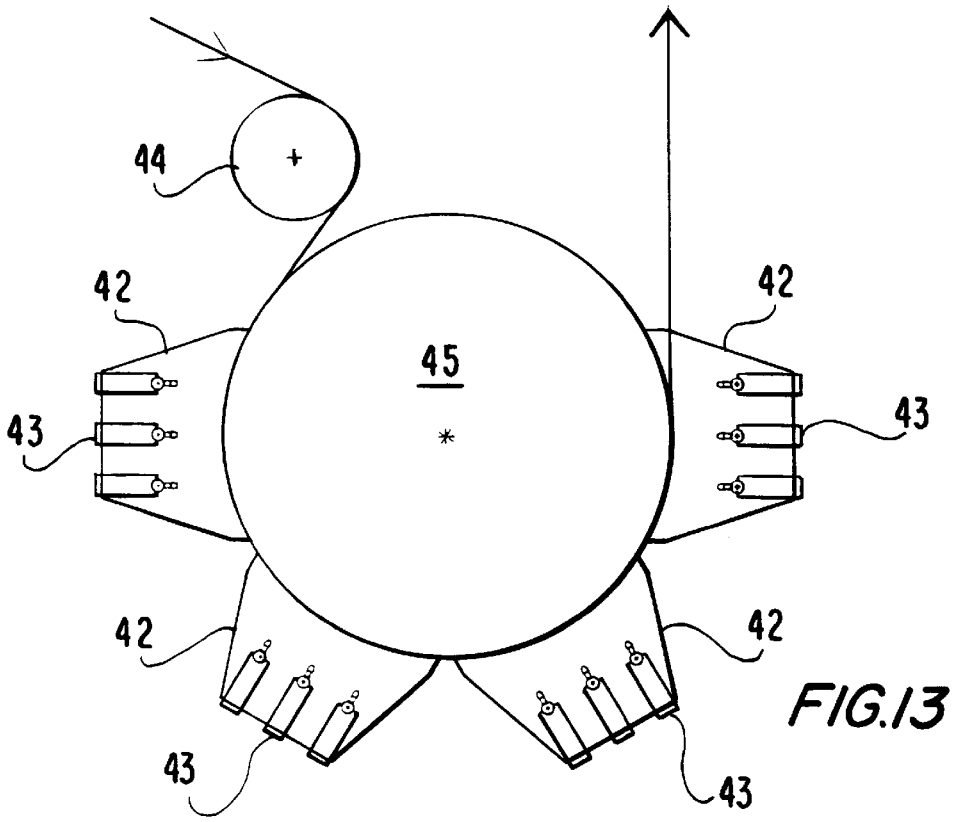
FIG. 13 shows a coater unit according to the present invention having three applicator assemblies mounted about a single backing roll.
Figure 14:
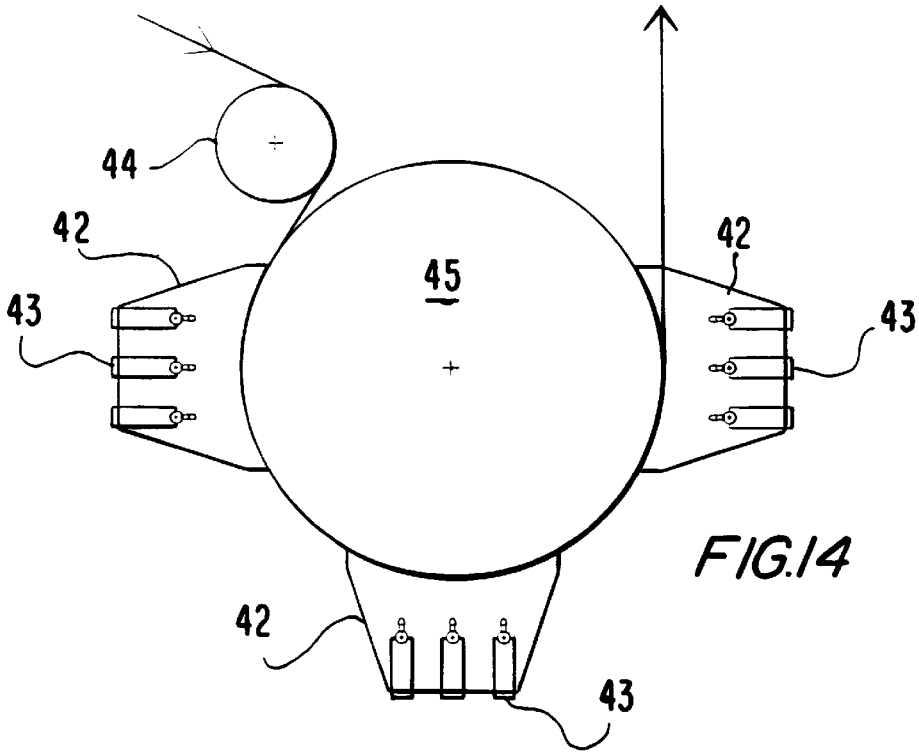
FIG. 14 shows a coater unit according to the present invention having four applicator assemblies mounted about a single backing roll.

FIGS. 13 and 14 show two exemplifying embodiments of spray-coater units. The coater unit of FIG. 13 comprises a guide/tensioning roll 44 a backing roll 45 and four applicator assemblies 42, each including three parallel linear nozzle arrays 43. In this fashion, a sequence of four successive coat layer applications can be adapted into a single coater unit. The coater unit of FIG. 14 has three applicator assemblies. Although the spray-coater units are shown in FIGS. 13 and 14 as having four and three applicator assemblies 42, respectively, each spray-coater unit may have fewer or more applicator assemblies. The sole purpose of these illustrations is to bring forth a practicable structure of the spray-coater unit according to the present invention and to elucidate the minimal space need of such a coater. Owing to their simple structure and minimal space requirement, the coater units can be located in almost any position in the coating line, even inside a paper machine, whereby these coaters make it possible to implement a wide variety of coating lines as outlined above. Different constructions of spray-coater units are described in greater detail in a co-pending patent application based on the same priority application as the present patent application.

The method according to the present invention has been applied in coating tests with results discussed below.

Coating of a full-width web in the tests was generally successful, even to an unexpectedly good degree. Three adjacent spraying zones did not provide a sufficient capacity for attaining high web speeds. The coating capacity was approximately 10 g/m$^2$ at 220 m/min web speed and approx. 5 g/m$^2$ at 470 m/min. The solids content of the coating mix was 40%. This test did not aim at determining the maximum performance values of the method.

Spray-coating is hampered by strong dusting of the spraying point environment by coating mix particles. The atomized spray of small coating mix droplets can spread everywhere along with air streams unless collected away in a controlled manner. Additionally, the air film travelling with the moving web surface tends to drag along the dust. In the test runs, a blade made from polyacrylate sheet was used for doctoring the air film away.

The kinetic energy imparted to the sprayed droplets must be sufficiently high, particularly at high web speeds, in order to prevent the moving air film from entraining the coating mix spray even before the spray can impinge on the web surface.

In the test run, the capacity of the nozzles per unit time was measured. When the amount of coating mix adhering to the web is known, also the portion lost in the environment can be calculated. Adjustment of suction fan capacity was found to affect the applied coat weight to a significant degree. The stronger the suction, the less coat could be deposited on the web surface.

The capacity of the nozzles was measured for two different types of nozzles. Nozzle code FF-610 indicates a nozzle with 60° spray angle and 0.010" (0.254 mm) nozzle orifice diameter. The other nozzle tested was with the same spray angle but with 0.012" (0.305 mm) orifice.

The actual tests were performed on the FF-610 nozzle at 160 bar pressure, whereby the nozzle output was 7.5 g/s of wet coating mix. The coating efficiencies (portion of coating mix adhered to the web from the overall amount of sprayed coating mix) at different web speeds are calculated in Table 1.

TABLE 1

Coating efficiency vs. web speed.

| Test point | Av. coat weight over 1 · m unit width of web [g/m$^2$] | Web speed [m/min] | Coating efficiency [%] |
|---|---|---|---|
| 218 | 10.0 | 220 | 87 |
| 221 | 5.0 | 470 | 93 |
| 223 | 7.5 | 280 | 83 |
| 229 | 5.0 | 449 | 89 |

As can be seen, the coating efficiency varied in the range 83–93%. On the average, the loss of sprayed coating mix was 12%.

The webs were measured for cross-machine profiles of base weight, ash and caliper. To speed the measurement, all five profiles were printed sequentially into the same profile plot.

The measurement results shown that the fan-shaped spray pattern of the individual nozzles remains very clearly detectable and the coat weight profile is peaked. Profile deviation from nominal coat weight can be as much as about 6 g/m$^2$ per side. A peak is seen in the coat weight profile at the intersection of the fan edges. Examination of the coat profiles gives a peak-to-peak deviation of 40–60% from the overall coat weight. An interesting observation is, however, that the profile errors are not particularly visible on the finished product, which is indicative of the good opacifying power of the coat. The edge areas of the sprays can be blended smoother by making the spray angle of the nozzles wider, and the greater number of spraying zones required at higher web speeds will finally reduce the fan intersection errors to an insignificant level. Low web speeds necessitate the use of lower-output nozzles to prevent the errors of a single application zone from becoming excessively pronounced. When arranged into a three-row array, the nozzles tested herein are sufficient for applying a coat weight of 10 g/m$^2$ at 220 m/min web speed. To apply the same coat weight at a web speed of 440 m/min, the spray-coater would require a 6-row nozzle assembly, for a web speed of 880 m/min a 12-row assembly and so forth. Then, the profile error caused by a single nozzle will be reduced respectively.

While the coat profiles of a paper passed through a SymSizer size press are peak-free, a certain amount of skew toward the drive side can be seen. A pronounced valley occurs in the coat weight profile very close to the drive-side edge.

Prior to the tests, the greatest doubts were expressed with regard to the surface strength of the sprayed coat. Intuitively, the coat mist was expected to settle in the same fashion as snowflakes on the sheet surface. However, no differences could be found in the coat surface strength in contrast to paper passed through a SymSizer size press. Also the rolls of the supercalender and the printing machine remained free from buildup of coat dirt. Additionally, such a high coat surface strength indicated that the coating mix does not undergo phase separation when exiting the nozzle.

The coated paper was supercalendered to test runnability of spray-coated paper on a full-scale supercalender and to compare its behavior with that of supercalendered paper passed through a SymSizer size press. The spray-coated paper grades were found uncomplicated to run on a calender. The calender rolls remained free from buildup of coat dirt.

The spray-coated paper grades were readily printable. On the basis of samples returned from the printing shop, the following observation could be made:

- spray-coating is a viable application method for coating a web;
- buildup of coat dirt on the rolls of printing machines using spray-coated paper remains insignificant;
- a pronounced difference is seen between the surfaces of transfer-coated and spray-coated paper grades that becomes more accentuated at higher coat weights;
- spray-coating gives a smoother visual appearance, but not as good a printed surface gloss and density as that offered by a transfer-coated paper;
- orange-peel texture is more pronounced on a transfer coated sheet;
- supercalendering of the base sheet clearly improves the surface quality of spray-coated paper.

Overall results of web coating by spraying techniques widely surpassed expectations. Paper surface strength in calendering and printing is imperative prerequisite for further development of the method. At least on the basis of tests performed, sufficient strength of coat surface seems to be attainable.

As compared visually to a comparative sample passed through a SymSizer size press, the paper surface and printing quality seemed smooth, even promising. Under visual examination, the print gloss and density of spray-coated paper did not reach the quality level of the comparative sample.

The paper surface appears well-opacified and no sign of "cracker bread" effect (that is, splashing of coat as large droplets on the sheet surface) was present. Obviously, due to the fully conformant deposition of the coat layer applied by the spraying technique, the method has some special characteristics and thus sets certain requirements for the coating process. Accordingly, the base sheet should have a maximally smooth surface.

Thus, while there have been shown and described and pointed out fundamental novel features of the present invention as applied to preferred embodiments thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

The operating life of nozzles could not be evaluated within the time span of tests performed. Experiences from similar nozzles used in painting technology indicate that the nozzle life will be rather limited, because abrasive wear of the nozzle causes progressive narrowing of the spray angle and widening of the nozzle orifice, whereby both the surface quality and coat profile will suffer. Therefore, the service life of nozzles in the spraying of coating mixes need to be assessed in detail.

What is claimed is:

1. A method for coating a moving web of paper or paperboard with a coating mix, comprising:

(a) applying a layer of coating mix to a surface of a moving web of paper or paperboard by spraying an atomized mist of the coating mix onto the surface of the web by means of a plurality of substantially airless high pressure spraying nozzles positioned across a width of the web, a spray pattern width of each spraying nozzle at a point where spray from the nozzle contacts the surface of the web being less than the width of the web; and (b) at least partially drying the applied coating mix.

2. The method of claim 1, wherein the web is precalendered prior to applying the coating mix.

3. The method of claim 1, wherein steps (a) and (b) are repeated at least once and the applied coating mix is dried before step (a) is repeated.

4. The method of claim 1, wherein steps (a) and (b) are repeated at least twice and the applied coating mix is dried each time before step (a) is repeated.

5. The method of claim 1, wherein steps (a) and (b) are repeated at least once and the applied coating mix is not completely dried before additional coating mix is applied.

6. The method of claim 3, wherein in each coating step, a coating mix having a different formulation is used.

7. The method of claim 1, further comprising applying a layer of a coating mix to the surface of the web by means of a roll applicator, said step of applying coating mix with the roll applicator being followed by said step (a), wherein in said step (a) the coating mix is applied onto the coating applied by the roll applicator, and wherein the coating mix applied by the roll applicator is not completely dried before coating mix is applied in said step (a).

8. The method of claim 1, further comprising applying a layer of a coating mix to the surface of the web by means of a short-dwell applicator, said step of applying coating mix with the short-dwell applicator being followed by said step (a), wherein in said step (a) the coating mix is applied onto the coating applied by the short-dwell applicator, and wherein the coating mix applied by the short-dwell applicator is not completely dried before coating mix is applied in said step (a).

9. The method of claim 1, wherein in said step (a) more than one layer of coating mix is applied to the web by the spraying nozzles.

10. The method of claim 9, further comprising, subsequent to said step (b), (c) applying a layer of coating mix onto the layers of coating mix applied in said step (a).

11. The method of claim 9, wherein two layers of coating mix are applied in step (a), and wherein the two layers of coating mix applied in step (a) are dried in said step (b).

12. The method of claim 1, wherein steps (a) and (b) are repeated at least once and the web is calendered after said step (b) and before step (a) is repeated.

13. The method of claim 1, wherein the coating mix supplied to the spraying nozzles is supplied at a pressure of from 100 bar to 1000 bar.

14. The method of claim 1, wherein the coating mix supplied to the spraying nozzles is supplied at a pressure of from 100 bar to 300 bar.

15. The method of claim 1, wherein the spray pattern width of the spraying nozzles is from about 10 cm to about 30 cm.

16. The method of claim 1, wherein an axis of the spray patterns of the spraying nozzles is rotated by about 7° to about 15° with respect to a cross-machine axis of the spraying nozzles.

17. The method of claim 1, wherein at least one of a distance between spraying nozzles and a distance between the spraying nozzles and the web is adjustable.

18. An apparatus for coating a moving web of paper or paperboard with a coating mix, comprising:

a conveying means for conveying a web of paper or paperboard;

a first coater station for applying a layer of a coating mix to a surface of the web, and conveying means conveying the web to said first coater station, said first coater station comprising a spray-coater for spraying an atomized mist of the coating mix onto the surface of the web, said spray-coater comprising a plurality of substantially airless high pressure spraying nozzles positioned across a width of the web, a spray pattern width of each spraying nozzle at a point where spray from the nozzle contacts the surface of the web being less than the width of the web; and a first drying means for at least partially drying the coating mix applied to the web at said first coater station, said conveying means conveying the web from said first coater station to said first drying means.

19. The apparatus of claim 18, further comprising:

a second coater station for applying a layer of a coating mix to a surface of the web, said conveying means conveying the web from said first drying means to said second coater station, said second coater station comprising a spray-coater for spraying the coating mix onto the surface of the web, said spray-coater comprising a plurality of high pressure spraying nozzles positioned across a width of the web, a diameter of a spray pattern of each spraying nozzle at a point where spray from the nozzle contacts the surface of the web being less than the width of the web; and a second drying means for at least partially drying the coating mix applied to the web at said second coater station, said conveying means conveying the web from said first coater station to said second drying means.

20. The apparatus of claim 19, further comprising a precalender to calender the web positioned before the web enters said first coater station, said conveying means conveying the web from said precalender to said coater station.

21. The apparatus of claim 20, further comprising a calender to calender the web positioned to calender the web after the web leaves said second drying means, said conveying means conveying the web from said second drying means to said calender.

22. The apparatus of claim 21, further comprising a winder positioned to wind the web after the web has passed through said calender.

23. The apparatus of claim 21, further comprising:

a third coater station for applying a layer of a coating mix to a surface of the web, said conveying means conveying the web from said calender to said third coater station, said third coater station comprising a spray-coater for spraying the coating mix onto the surface of the web, said spray-coater comprising a plurality of high pressure spraying nozzles positioned across a width of the web, a diameter of a spray pattern of each spraying nozzle at a point where spray from the nozzle contacts the surface of the web being less than the width of the web; and a third drying means for at least partially drying the coating mix applied to the web at said third coater station, said conveying means conveying the web from said third coater station to said third drying means.

24. The apparatus of claim 23, further comprising:

a fourth coater station for applying a layer of a coating mix to a surface of the web, said conveying means conveying the web from said third drying means to said fourth coater station, said fourth coater station comprising a spray-coater for spraying the coating mix onto the surface of the web, said spray-coater comprising a plurality of high pressure spraying nozzles positioned across a width of the web, a diameter of a spray pattern of each spraying nozzle at a point where spray from the nozzle contacts the surface of the web being less than the width of the web; and a fourth drying means for at least partially drying the coating mix applied to the web at said fourth coater station, said conveying means conveying the web from said fourth coater station to said fourth drying means.

25. The apparatus of claim 24, further comprising a final calender to calender the web positioned to calender the web after the web leaves said fourth drying means, said conveying means conveying the web from said fourth drying means to said final calender.

26. The apparatus of claim 25, further comprising a winder positioned to wind the web after the web has passed through said final calender.

27. The apparatus of claim 26, wherein said conveying means conveys the web from a paper machine to said first coater station.

28. The apparatus of claim 18, further comprising:

a second coater station for applying a layer of a coating mix to a surface of the web, said conveying means conveying the web from said first drying means to said second coater station, said second coater station comprising a spray-coater for spraying the coating mix onto the surface of the web, said spray-coater comprising a plurality of high pressure spraying nozzles positioned across a width of the web, a diameter of a spray pattern of each spraying nozzle at a point where spray from the nozzle contacts the surface of the web being less than the width of the web;

a second drying means for at least partially drying the coating mix applied to the web at said second coater station, said conveying means conveying the web from said first coater station to said second drying means;

a third coater station for applying a layer of a coating mix to a surface of the web, said conveying means conveying the web from said second drying means to said third coater station, said third coater station comprising a spray-coater for spraying the coating mix onto the surface of the web, said spray-coater comprising a plurality of high pressure spraying nozzles positioned across a width of the web, a diameter of a spray pattern of each spraying nozzle at a point where spray from the nozzle contacts the surface of the web being less than the width of the web;

a third drying means for at least partially drying the coating mix applied to the web at said third coater station, said conveying means conveying the web from said third coater station to said third drying means;

a fourth coater station for applying a layer of a coating mix to a surface of the web, said conveying means conveying the web from said third drying means to said fourth coater station, said fourth coater station comprising a spray-coater for spraying the coating mix onto the surface of the web, said spray-coater comprising a plurality of high pressure spraying nozzles positioned across a width of the web, a diameter of a spray pattern of each spraying nozzle at a point where spray from the nozzle contacts the surface of the web being less than the width of the web; and a fourth drying means for at least partially drying the coating mix applied to the web at said fourth coater station, said conveying means conveying the web from said fourth coater station to said fourth drying means.

29. The apparatus of claim 28, further comprising a final calender to calender the web positioned to calender the web after the web leaves said fourth drying means, said conveying means conveying the web from said fourth drying means to said final calender.

30. The apparatus of claim 29, further comprising a winder positioned to wind the web after the web has passed through said final calender.

31. The apparatus of claim 30, further comprising an unwinder for unwinding a wound roll of the web, said conveying means conveying the web from said unwinder to said first coater station.

32. The apparatus of claim 19, further comprising:

a first blade coater station comprising a blade coater for applying a layer of coating mix to the web, said conveying means conveying the web from said second drying means to said first blade coater station;

a third drying means for at least partially drying the coating mix applied to the web by said first blade coater station, said conveying means conveying the web from said first blade coater station to said third drying means;

a second blade coater station comprising a blade coater for applying a layer of coating mix to the web, said conveying means conveying the web from said third drying means to said second blade coater station; and a fourth drying means for at least partially drying the coating mix applied to the web by said second blade coater station, said conveying means conveying the web from said second blade coater station to said fourth drying means.

33. The apparatus of claim 32, further comprising a final calendar adapted to receive the web from said fourth drying means, and a winder positioned to wind the web after the web has passed through said final calendar.

34. The apparatus of claim 33, further comprising an unwinder for unwinding a wound roll of the web, said conveying means conveying the web from said unwinder to said first coater station.

35. The apparatus of claim 19, further comprising:

a precalender to calender the web, said conveying means conveying the web to said precalender;

a first blade coater station comprising a blade coater for applying a layer of coating mix to the web, said conveying means conveying the web from said precalender to said first blade coater station;

a third drying means for at least partially drying the coating mix applied to the web by said first blade coater station, said conveying means conveying the web from said first blade coater station to said third drying means;

a second blade coater station comprising a blade coater for applying a layer of coating mix to the web, said conveying means conveying the web from said third drying means to said second blade coater station; and a fourth drying means for at least partially drying the coating mix applied to the web by said second blade coater station, said conveying means conveying the web from said second blade coater station to said fourth drying means;

wherein said conveying means conveys the web from said fourth drying means to said first coater station.

36. The apparatus of claim 35, further comprising a final calender to calender the web positioned to calender the web after the web leaves said second drying means, said conveying means conveying the web from said second drying means to said final calender.

37. The apparatus of claim 36, further comprising a winder positioned to wind the web after the web has passed through said final calender.

38. The apparatus of claim 37, further comprising an unwinder for unwinding a wound roll of the web, said conveying means conveying the web from said unwinder to said first blade coater station.

39. The apparatus of claim 19, further comprising:

a precalender to calender the web, said conveying means conveying the web to said precalender;

a first transfer coater station comprising a transfer coater for applying a layer of coating mix to the web, said conveying means conveying the web from said precalender to said first transfer coater station;

a third drying means for at least partially drying the coating mix applied to the web by said first transfer coater station, said conveying means conveying the web from said first transfer coater station to said third drying means;

a second transfer coater station comprising a transfer coater for applying a layer of coating mix to the web, said conveying means conveying the web from said third drying means to said second transfer coater station;

a fourth drying means for at least partially drying the coating mix applied to the web by said second transfer coater station, said conveying means conveying the web from said second transfer coater station to said fourth drying means; and an intermediate calender to calender the web positioned to calender the web after the web leaves said fourth drying means, said conveying means conveying the web from said intermediate calender to said first coater station.

40. The apparatus of claim 39, further comprising a final calender to calender the web positioned to calender the web after the web leaves said second drying means, said conveying means conveying the web from said second drying means to said final calender.

41. The apparatus of claim 40, further comprising a winder positioned to wind the web after the web has passed through said final calender.

42. The apparatus of claim 41, further comprising an unwinder for unwinding a wound roll of the web, said conveying means conveying the web from said unwinder to said first transfer coater station.

43. The apparatus of claim 35, further comprising a winder positioned to wind the web after the web has passed through said second drying means.

44. The apparatus of claim 18, wherein all of said drying means at least partially dry coating mix applied to the web noncontactingly, and wherein the web travels substantially in a straight line from each coater station to a following drying means.

45. The apparatus of claim 19, wherein all of said drying means at least partially dry coating mix applied to the web noncontactingly, and wherein the web travels substantially in a straight line from each coater station to a following drying means.

46. The apparatus of claim 23, wherein all of said drying means at least partially dry coating mix applied to the web noncontactingly, and wherein the web travels substantially in a straight line from each coater station to a following drying means.

47. The apparatus of claim 24, wherein all of said drying means at least partially dry coating mix applied to the web noncontactingly, and wherein the web travels substantially in a straight line from each coater station to a following drying means.

48. The apparatus of claim 28, wherein all of said drying means at least partially dry coating mix applied to the web noncontactingly, and wherein the web travels substantially in a straight line from each coater station to a following drying means.

49. The apparatus of claim 32, wherein all of said drying means at least partially dry coating mix applied to the web noncontactingly, and wherein the web travels substantially in a straight line from each coater station to a following drying means.

50. The apparatus of claim 35, wherein all of said drying means at least partially dry coating mix applied to the web noncontactingly, and wherein the web travels substantially in a straight line from each coater station to a following drying means.

51. The apparatus of claim 39, wherein all of said drying means at least partially dry coating mix applied to the web noncontactingly, and wherein the web travels substantially in a straight line from each coater station to a following drying means.

52. The apparatus of claim 18, wherein the spray pattern width of the spraying nozzles is from about 10 cm to about 30 cm.

53. The apparatus of claim 18, wherein an axis of the spray patterns of the spraying nozzles is rotated by about 7° to about 150° with respect to a cross-machine axis of the spraying nozzles.

54. The apparatus of claim 18, wherein at least one of a distance between spraying nozzles and a distance between the spraying nozzles and the web is adjustable.

* * * * *